US006152812A

United States Patent [19]

Sung et al.

[11] Patent Number: 6,152,812

[45] Date of Patent: Nov. 28, 2000

[54] PUNCHING MACHINE FOR CUTTING GLASS

[75] Inventors: Wen-Chih Sung; Huo-Chen Tsai, both of Taipei, Taiwan

[73] Assignee: Chunghwa Pictures Tubes, Ltd., Taipei, Taiwan

[21] Appl. No.: 09/349,160

[22] Filed: Jul. 8, 1999

[51] Int. Cl.[7] ..... B24B 7/00; B24B 9/00

[52] U.S. Cl. ..... 451/180; 451/178; 83/128

[58] Field of Search ..... 451/51, 61, 76, 451/177, 178, 180; 83/128

[56] References Cited

U.S. PATENT DOCUMENTS

| | | | |
|---|---|---|---|
| 3,190,160 | 6/1965 | Armcost | 83/128 |
| 3,620,113 | 11/1971 | Gargrave | 83/128 |
| 4,051,754 | 10/1977 | Harcuba et al. | 83/128 |
| 4,691,602 | 9/1987 | Schlueter | 83/128 |
| 4,704,825 | 11/1987 | Moore | 451/51 |
| 5,482,498 | 1/1996 | Hisgashikawa | 451/51 |

*Primary Examiner*—Derris H. Banks
*Attorney, Agent, or Firm*—Bacon & Thomas, PLLC

[57] ABSTRACT

A punching machine for cutting glass having a punch body comprises a hollow punch holder on a top side of the punch body; a hollow punch on a bottom side of the punch body having a cavity on a front end and a circumferential portion with a plurality of sand formed thereon surrounding an outer surface of the cavity an elastic member; and a knockout pin provided through the punch holder and the punch having one end urged against one end of the elastic member in the punch holder and the other end extended downwardly from the cavity in a stored position; whereby as the circumferential portion is cutting through a glass surface, the knockout pin is urging against a portion of glass until the portion is separated from the glass completely.

5 Claims, 2 Drawing Sheets

PUNCHING MACHINE FOR CUTTING GLASS

FIELD OF THE INVENTION

The present invention relates to a punching machine, and more particularly to a punching machine for cutting glass.

BACKGROUND OF THE INVENTION

Typically, a punching machine comprises a punch body including a punch holder on one side of the punch body, and a punch on the opposite side of the punch body. Punch has spiral ridges on shank and a pointed front end. Punch holder is held by a chuck. As a result, the punching machine is tightly held.

However, for example, as the conventional punching machine punches a hole on a glass, a short furlike edge will be formed on the punched hole due to the cutting speed and/or the spiral shape of the punch. To the worse, the short furlike edge even causes a break extended from the punched hole. In brief, products made by such conventional punching machine is poor in quality. Further, life cycle of punch is relatively short.

A need remains for an improved punching machine in order to overcome the above drawbacks of prior art.

SUMMARY OF THE INVENTION

It is an object of the present invention to provide a punching machine comprising a punch body including a hollow punch holder on one side of the punch body, a hollow punch on the opposite side of the punch body having a cylindrical cavity on a front end and a circumferential portion with a plurality of abrasive sand formed thereon surrounding an outer surface of cylindrical cavity, an elastic member received in the punch holder, and a knockout pin penetrated through the punch and the punch holder having one end urged against the elastic member and the other end extended from a bottom of the cylindrical cavity in a stored position. As the circumferential portion of the punch is cutting through a glass surface, the knockout pin is urging against a portion to be punched until the portion is separated from the glass completely, thereby preventing a short furlike edge and a break from occurring as well as prolonging life cycle of the punch.

The above and other objects, features and advantages of the present invention will become apparent from the following detailed description taken with the accompanying drawings.

DETAILED DESCRIPTION OF THE PREFERRED EMBODIMENTS

Figure 1:
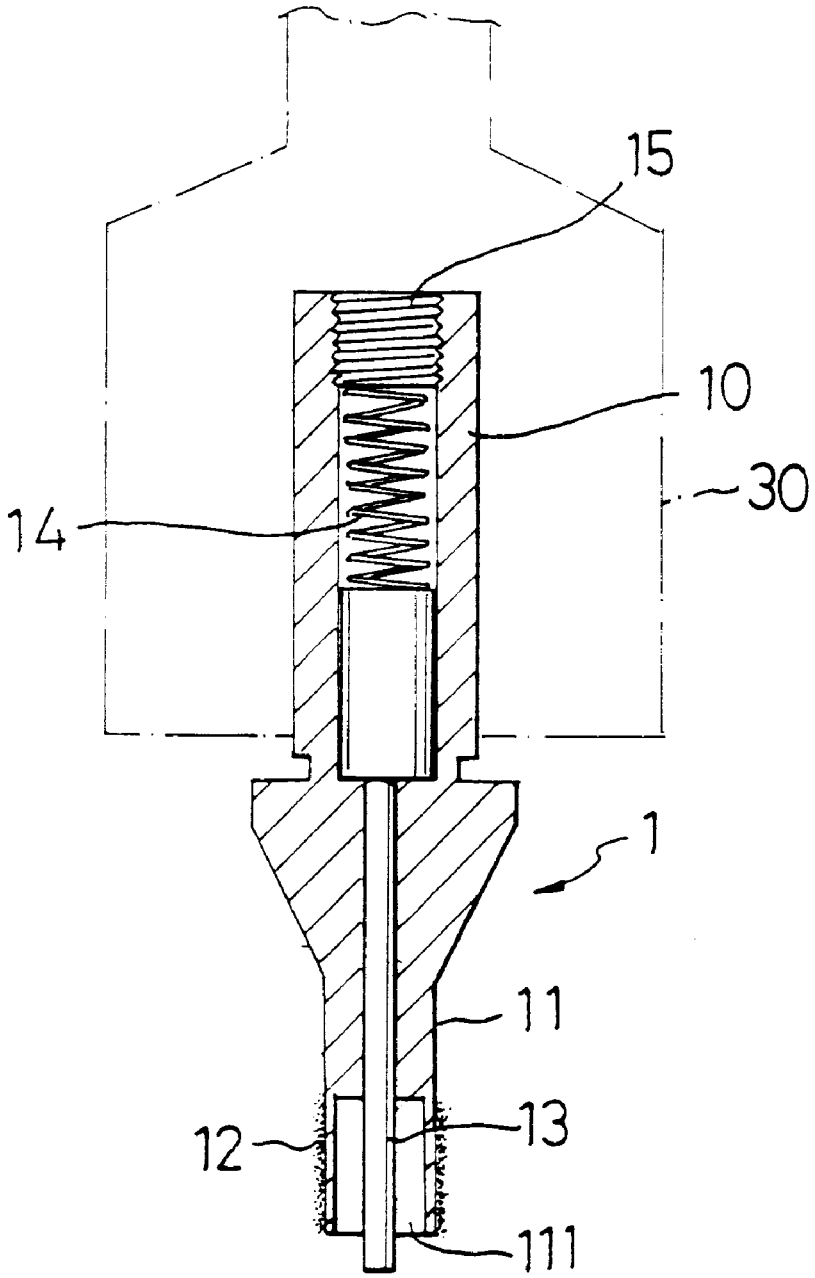
FIG. 1 is a cross-sectional view of the present invention.

Referring to FIG. 1, there is shown a punching machine according to the invention comprising a punch body 1 including a hollow cylindrical punch holder 10 on one side of the punch body 1 being tightly held by a chuck 30, a hollow punch 11 on the opposite side of the punch body 1 having a cylindrical cavity 111 on a front end and a circumferential portion 12 with a plurality of sand (e.g., abrasive sand) formed thereon surrounding an outer surface of cylindrical cavity 111 in which inner diameter of the axial through hole of punch holder 10 is larger than that of punch 11, and inner diameter of the axial through hole of cylindrical cavity 111 is larger than that of punch 11, an elastic member (e.g., a helical spring) 14 received in the punch holder 10 having the top secured to a fastener (e.g., bolt) 15, and a knockout pin 13 provided through the hollow punch 11 and the hollow punch holder 10 having one end urged against the elastic member 14 and the other end extended from a bottom of the cylindrical cavity 111 in a stored position.

Figure 2:
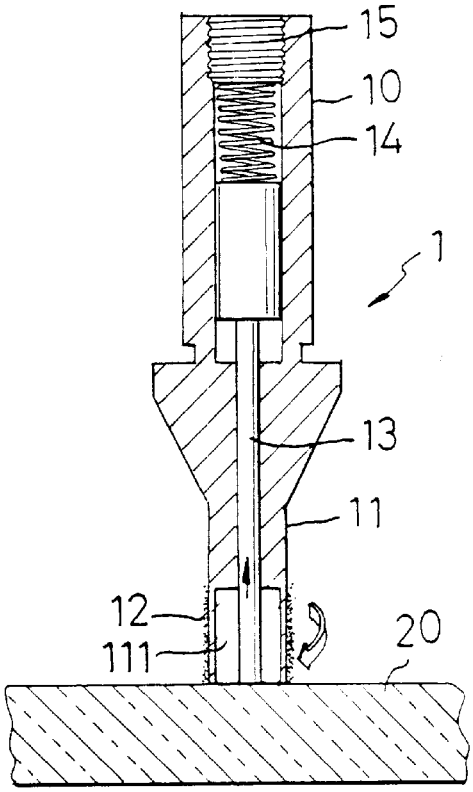
FIGS. 2–3 are cross-sectional views of an embodiment illustrating the operation of the present invention.
Figure 3:
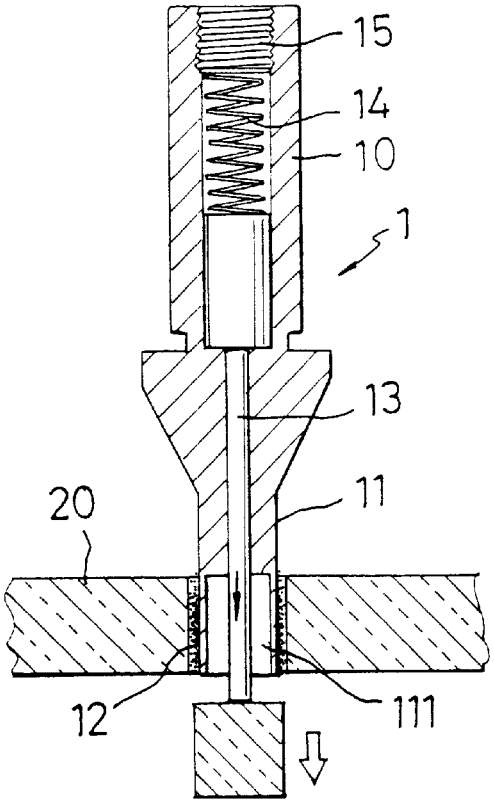

As shown in FIGS. 2–3, the knockout pin 13 is retracted into the cylindrical cavity 111 when urged against a glass 20 surface prior to punching due to the compression of elastic member 14. It is designed that the punching machine is operated in a nominal speed. Once enabled, knockout pin 13 begins to extend from bottom of the cylindrical cavity 111 gradually as the punch 11 continuously stamps on glass 20. The circumferential portion 12 used as a cutting tool also gradually penetrates through glass 20 as the knockout pin 13 is urging against a portion of glass 20 until the portion is separated from glass 20 completely, thereby preventing a short furlike edge and a break from occurring as well as prolonging life cycle of the punch 22.

While the invention herein disclosed has been described by means of specific embodiments, numerous modifications and variations could be made thereto by those skilled in the art without departing from the scope of the invention set forth in the claims.

What is claimed is:

1. A punching machine having a punch body comprising:

a hollow cylindrical punch holder having a first axial through hole on a top side of the punch body;

a hollow punch having a second axial through hole on a bottom side of the punch body having a cylindrical cavity on a front end and a circumferential portion with a plurality of sand formed thereon surrounding an outer surface of the cylindrical cavity;

an elastic member; and a knockout pin provided through the first axial through hole and the second axial through hole having one end urged against one end of the elastic member in the punch holder and the other end extended a predetermined distance from a bottom of the cylindrical cavity in a stored position;

whereby as the circumferential portion of the punch is cutting through a glass surface, the knockout pin is urging against a portion of the glass until the portion is separated from the glass completely.

2. The punching machine of claim 1, wherein an inner diameter of the first axial through hole is larger than that of the second axial through hole, and an inner diameter of the cylindrical cavity is larger than that of the second axial through hole.

3. The punching machine of claim 1, wherein the sand is an abrasive sand.

4. The punching machine of claim 1, wherein the other end of the elastic member is secured to a fastener.

5. The punching machine of claim 1 or 4, wherein the elastic member is a spring.

* * * * *